US006089333A

United States Patent [19]

Rise

[11] Patent Number: 6,089,333

[45] Date of Patent: Jul. 18, 2000

[54] DEVICE FOR STORING PIPES

[76] Inventor: Terje Rise, Plogveien 10, N-4042 Hafrsfjord, Norway

[21] Appl. No.: 09/026,589

[22] Filed: Feb. 20, 1998

(Under 37 CFR 1.47)

[30] Foreign Application Priority Data

Feb. 21, 1997 [NO] Norway ..... 970801

[51] Int. Cl.[7] ..... E21B 19/14

[52] U.S. Cl. ..... 175/85; 175/52; 414/22.63

[58] Field of Search ..... 175/52, 85, 122, 175/113, 121, 162; 166/72.1, 76.1, 85.1, 379; 414/22.63, 22.53, 22.51

[56] References Cited

U.S. PATENT DOCUMENTS

| | | | |
|---|---|---|---|
| 3,768,663 | 10/1973 | Turner, Jr. et al. | 175/85 X |
| 4,445,579 | 5/1984 | Bello | 175/52 |
| 5,174,389 | 12/1992 | Hansen | 175/52 |
| 5,297,642 | 3/1994 | Rajakallio et al. | 175/84 |
| 5,437,527 | 8/1995 | McGill et al. | 175/85 X |
| 5,806,613 | 9/1998 | Sparks et al. | 175/52 |

FOREIGN PATENT DOCUMENTS

| | | |
|---|---|---|
| 180392 | 2/1997 | Norway . |
| 1455509 | 11/1976 | United Kingdom . |
| 1455510 | 11/1976 | United Kingdom . |
| 2155974 | 10/1985 | United Kingdom . |

*Primary Examiner*—Frank Tsay
*Attorney, Agent, or Firm*—Andrus, Sceales, Starke & Sawall

[57] ABSTRACT

The present invention relates to a device for storing pipes, especially in vertical position, and for the purpose of providing an improved structure wherein a better utilization of the storage area is achieved, the pipe handling can be effected in a faster and safer manner, and wherein the device can more easily be adjusted for various pipe dimensions, it is according to the present invention suggested that the device comprises an upper supporting means (11; 111) having one or more curved fingers (13*a;* 113*a*) for providing arch-shaped storage paths (17*x,* 17*y;* 117*x,* 117*y*) for pipes (7; 7').

10 Claims, 3 Drawing Sheets

DEVICE FOR STORING PIPES

FIELD OF THE INVENTION

The present invention relates to a device for storing pipes, especially in vertical position.

BACKGROUND OF THE INVENTION

In connection with drilling for oil and gas there are heavy requirements as regards capacity and safety in respect of pipe handling. There exist a plurality of various handling systems on today's market, and the present invention has for an objective to provide an improved device for storing pipes whereby the handling and storing operations can be effected in a rational and appropriate manner.

PRIOR ART

In connection with the stacking of pipes vertically in a derrick, there are specifically two types which will be discussed in the following.

A first method is to the fact of positioning the pipes between stationary parallel fingers. This will give a good utilization of the storage area, but there are required four movements of the pipe handling machine.

A second method is to the fact of arranging the fingers in a star-shaped pattern, such that the pipe handling machine itself can reside in the middle thereof. Thereby is achieved one movement less than in the first method by fetching or storing pipes in the pipe storage. However, this second method entails a poor utilization of the storage area, at the same time as the arms of the handling machine must be pulled in when turning said machine.

BRIEF DISCLOSURE OF THE INVENTION

The object of the present invention is to provide a device wherein the advantages of better area utilization in relation to said first method, and the advantages of a direct and rapid movement in relation to said second method, are combined in a novel and expedient arrangement. This is substantially achieved according to the invention in that the device comprises fingers which are arranged as partly or approximately fully circle-shaped configurations.

In a device of the type as stated in the preamble, this is consequently, according to the invention, characterized in that it comprises an upper supporting means having one or more curved fingers for providing arch-shaped storage paths for pipes.

Appropriately, the device can be designed so that the distance between the curved fingers can be adjusted, which entails that the storage paths between said curved fingers can be adjusted in width as regards the pipe size to be used.

According to the invention there is provided a device which by co-operation with a suitable pipe handling machine will operate more rapidly as regards the stacking or fetching of pipes, because, specifically in relation to said second method, it is not necessary to pull in the scissor arms of the pipe handling machines for allowing turning of the pipe handling machine to the opening of the selected storage path.

Still another advantage of the present device is to the fact that it may comprise an arbitrary number of sets of curved fingers, appropriately arranged around a pipe handling machine, and having appropriate pipe handling openings therebetween, for thereby enabling operation towards one, two or more well centres.

Further features and advantages of the present invention will appear from the following description taken in conjunction with the appending drawings.

BRIEF DISCUSSION OF THE DRAWINGS

DESCRIPTION OF EMBODIMENTS

Figure 1:
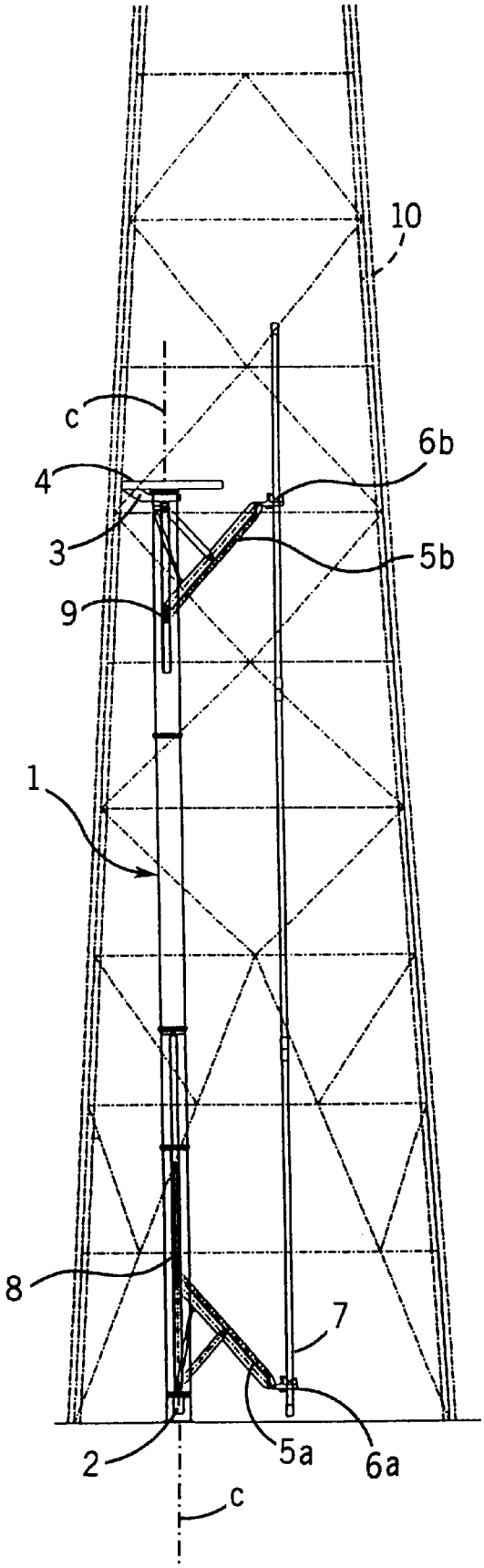
FIG. 1 is a schematical side view illustrating the main elements of a first embodiment of a device for handling pipes, according to the invention.

In FIG. 1 there is schematically illustrated a side view of the main elements included in a drilling system, wherein the present device for storing pipes according to the present invention, can be applied.

In FIG. 1 reference numeral 1 indicates a pipe handling machine which is designed substantially cylindrical and adapted to turn around a central centre axis C. The pipe handling machine 1 is pivotably supported in a bottom bearing 2 and arranged pivotable in an upper bearing 3, which can be built together with an upper finger drilling top structure 4, which will be discussed further with reference to FIG. 2.

The pipe handling machine 1 comprises a lower scissor arm 5*a* which at its outer end carried a lower claw 6*a* adapted to clamp around a pipe 7 and by means of a lifting mechanism 8 to lift and lower the pipe 7, and then through an upper claw 6*b* which is adapted to close around the pipe 7 for providing a guide for the latter, at the same time as the upper claw 6*b* is located outermost on the upper scissor arm 5*b*. The upper scissor arm 5*b* is manoeuvred by means of an upper mechanism 9.

In FIG. 1 there is illustrated by a dashed line a derrick assembly 10, in which derrick assembly there may be included one, two or more well centres with which the pipe handling machine 1 can communicate in an appropriate manner, and specifically in an expedient manner by using the device according to the present invention.

Figure 2:
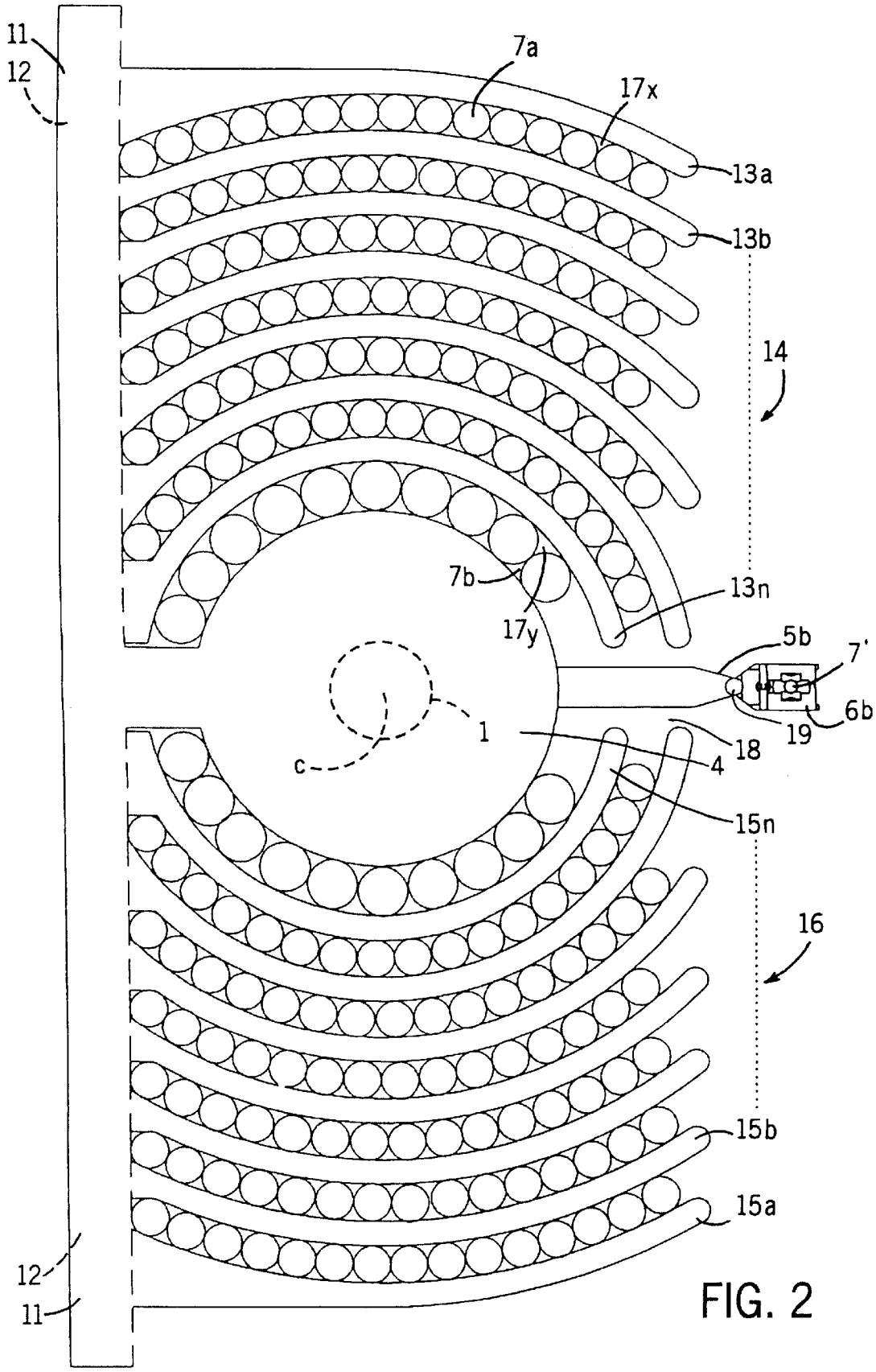
FIG. 2 is a plan view illustrating a first embodiment of the device according to the invention, especially adapted to a simple derrick solution, respectively an operation towards one well centre.

In FIG. 2 there is illustrated a first embodiment of a device for storing pipes, according to the invention, and in this Figure there is recognized the finger drilling top structure 4 which can be built together with, respectively comprise a supporting beam 11, provided with a longitudinally extending track 12 within, according to the invention, there are provided one or more curved fingers 13*a* . . . 13*n* in a first set 14 and a second unit of curved fingers 15*a* . . . 15*n* arranged in a second set 16. It is to be understood that the curved lingers are substantially arranged with the same radius of curvature, which means that between the respective curve fingers there will be defined correspondingly curved storage paths 17*x* and 17*y*.

By letting the curved fingers 13*a* . . . 13*n* and 15*a* . . . 15*n*, respectively, be arranged displaceable in said track 12 in the supporting beam 11, the width between said fingers can be adjusted, such that the width of the storage paths 17*x* and 17*y*, respectively, can be adjusted for adaption to the desired pipe dimension, for example pipes 7*a* of a lesser dimension in the storage path 17*x*, and for example pipes 7*b* of a larger dimension in the storage path 17*y*.

In FIG. 2 it is illustrated that the respective curved fingers are arranged in two sets 14 and 16, respectively, which means that the illustrated embodiment of the device encloses in a semi-ring-structure around the upper portion of the previously discussed pipe handling machine 1, and will through a pipe handling opening 18 between said two sets enable operation towards one well centre. Consequently, in said pipe handling opening 18 the upper scissor arm 5*b* with its upper claw 6*b* will be able to pass a pipe 7' to an appropriate position in front of the mouth of a storage path 17*x* and 17*y*, and by an appropriate turning of the claw 6*b* through an appropriate turning element 19 passing said pipe 7' in position in the storing device, or fetch a corresponding pipe therefrom towards the well centre.

Figure 3:
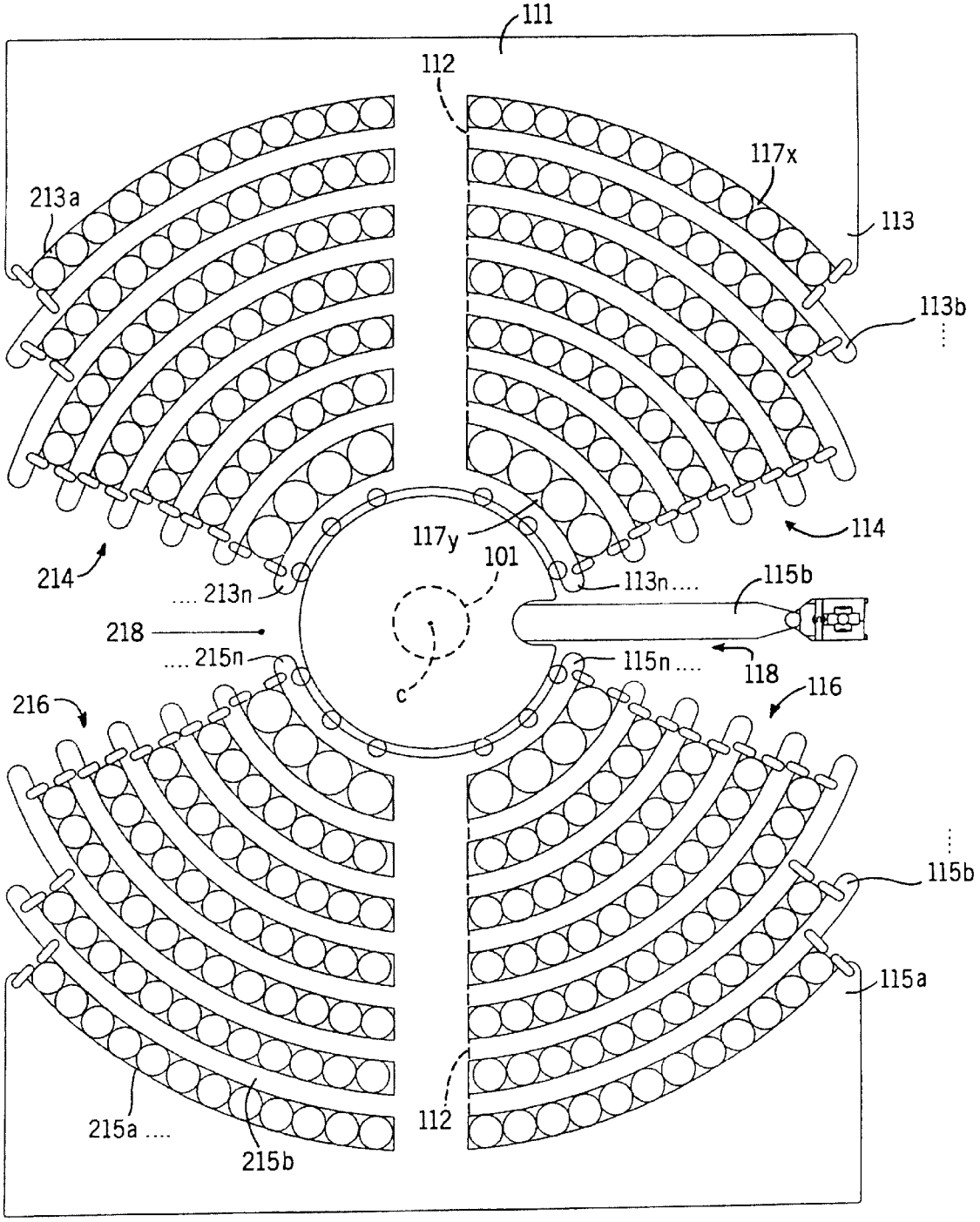
FIG. 3 is a plan view illustrating a second embodiment of the device according to the invention, especially related to a double derrick solution, respectively an operation towards two different well centres.

In FIG. 3 there is illustrated a second embodiment of a device for storing pipes according to the invention, wherein the pipe handling machine is designated by reference numeral 101 and the finger drilling top structure is designated by reference numeral 111, this embodiment of the finger drill top structure 111 being adapted for four set of curved fingers, namely a first set 114 comprising the finger 113*a* . . . 113*n*, and a second set 116 comprising fingers 115*a* . . . 15*n*, which fingers at their one end are attached in a channel 112 for mutual displacement and thereby adjustment of the mutually arranged storage paths 17*x*, 17*y*.

Said two mentioned sets 114 and 116 will therebetween define a pipe handling opening 118 wherein the upper scissor arm 115*b* of the pipe handling machine 101 can be brought forward and rearward for fetching and storing of pipes, respectively.

Correspondingly, on the diametrically opposite side of the finger drill top structure 112 there is provided a third set 114 with curved fingers 213*a* . . . 213*n* and a fourth set 216 comprising curved fingers 215*a* . . . 215*n*.

The four sets which are curved in a substantially full ring configuration about the rotation axis C for the pipe handling machine 101, will through their respective pipe handling openings, respectively 118 between the two first sets 114 and 116 and the pipe handling opening 218 between the third set 214 and the fourth 216, be able to operate towards two different well centres, arranged substantially diagonally in relation to each other in relation to said pipe handling machine 101.

By arranging an upper supporting means with one or more curved fingers, as this is suggested according to the present invention, there is achieved a device providing a plurality of arch-storage paths for pipes between said fingers, which means a great improvement as regards the utilization of storage area and the reduction in handling time.

Since said fingers are arranged for mutual in-between adjustment there may be provided storage paths having different widths adapted to the pipe dimensions in question in the various types of drilling.

During operation it is only necessary to pull in the scissor arms on the pipe handling machine so far that the respective claws of the scissor arms are flush with the mouth of the selected storage path, whereafter or at the same time as said claws are rotated to correct position, it being for the storage or the fetching of the selected pipe.

I claim:

1. A device for storing pipes, especially in a vertical position, the device comprising:

an upper supporting means (11, 111) having a plurality of curved fingers (13*a*, 113*a*) having different radii of curvature about a common center for providing arch-shaped storage paths (17*x*, 17*y*, 117*x*, 117*y*) for pipes (7, 7') therebetween.

2. The device of claim 1 wherein a first end of each curved finger is displaceable along a linear path for adjusting the width of the arch-shaped storage path between adjacent curved fingers.

3. The device of claim 1 wherein the arch-shaped storage paths are adapted with a central pipe handling machine (1) having claws (6*a*, 6*b*) arranged at a lower (5*a*) and an upper (5*b*) scissors arm, respectively, the claws being arranged pivotably on the respective scissors arm for tangentially guiding the claws along a selected storage path between two curved fingers.

4. A device for storing pipes, especially in a vertical position, the device comprising:

an upper supporting means (11, 111) having a plurality of curved fingers (13*a*, 113*a*) for providing arch-shaped storage paths (17*x*, 17*y*, 117*x*, 117*y*) for pipes (7, 7') between adjacent curved fingers, the curved fingers being arranged in two sets that are curved in a substantially semi-ring-structure about a rotation axis (c) of a pipe handling machine (1) having a pipe handling opening (18) between the two sets of fingers.

5. The device of claim 4 wherein a first end of each curved finger is displaceable along a linear path for adjusting the width of the arch-shaped storage path between adjacent curved fingers.

6. The device of claim 4 wherein the arch-shaped storage paths are adapted with a central pipe handling machine (1) having claws (6*a*, 6*b*) arranged at a lower (5*a*) and an upper (5*b*) scissors arm, respectively, the claws being arranged pivotably on the respective scissors arm for tangentially guiding the claws along a selected storage path between two curved fingers.

7. A device for storing pipes, especially in a vertical position, the device comprising:

an upper supporting means (11, 111) having one or more curved fingers (13*a*, 113*a*) for providing arch-shaped storage paths (17*x*, 17*y*, 117*x*, 117*y*) for pipes (7, 7') between adjacent curved fingers, wherein the curved fingers are arranged in four sets that are curved in a substantially full-ring-structure about a rotation axis (c) of a pipe handling machine (1) having a pipe handling opening (118, 218) between the four sets, especially related to two well centers.

8. The device of claim 7 wherein a first end of each curved finger is displaceable along a linear path for adjusting the width of the arch-shaped storage path between adjacent curved fingers.

9. The device of claim 7 wherein the arch-shaped storage paths are adapted with a central pipe handling machine (1) having claws (6*a*, 6*b*) arranged at a lower (5*a*) and an upper (5*b*) scissors arm, respectively, the claws being arranged pivotably on the respective scissors arm for tangentially guiding the claws along a selected storage path between two curved fingers.

10. A device for storing pipes, especially in a vertical position, the device comprising:

an upper supporting means (11, 111) having a plurality of curved fingers (13*a*, 113*a*), the curved fingers having different radii of curvature about a common center, the plurality of curved fingers being spaced to define a plurality of arch-shaped storage paths (17*x*, 17*y*, 117*x*, 117*y*) for pipes between adjacent curved fingers, wherein each curved finger includes a first end movable along a longitudinal track (12) such that the width of each arch-shaped storage path can be modified by moving the first end of one of the fingers defining the storage path along the longitudinal track.

* * * * *